US007953520B2

(12) United States Patent
Hayashi

(10) Patent No.: US 7,953,520 B2
(45) Date of Patent: May 31, 2011

(54) COOLING FAN CONTROLLER FOR CONTROLLING REVOLVING FAN BASED ON FLUID TEMPERATURE AND AIR TEMPERATURE

(75) Inventor: Yoshihiko Hayashi, Tokyo (JP)

(73) Assignee: Caterpillar S.A.R.L., Geneva (CH)

( * ) Notice: Subject to any disclaimer, the term of this patent is extended or adjusted under 35 U.S.C. 154(b) by 288 days.

(21) Appl. No.: 12/224,422

(22) PCT Filed: Mar. 8, 2007

(86) PCT No.: PCT/JP2007/054569

§ 371 (c)(1),
(2), (4) Date: Aug. 27, 2008

(87) PCT Pub. No.: WO2007/119318

PCT Pub. Date: Oct. 25, 2007

(65) Prior Publication Data

US 2009/0062963 A1 Mar. 5, 2009

(30) Foreign Application Priority Data

Mar. 20, 2006 (JP) ..... 2006-077136

(51) Int. Cl.
*G05D 23/00* (2006.01)
*G05B 13/02* (2006.01)
*F02D 7/00* (2006.01)

(52) U.S. Cl. ..... 700/299; 700/46; 700/276; 700/300; 123/392; 123/399; 236/91 R; 236/91 F; 236/98; 432/36; 432/49

(58) Field of Classification Search ..... 700/46, 700/276, 299–300; 73/114.68; 123/41.44, 123/41.46, 392, 399.98, 399; 399/92–94; 236/44, 91, 44 R, 91 R, 91 F, 98; 432/36–49
See application file for complete search history.

(56) References Cited

U.S. PATENT DOCUMENTS

| | | | | |
|---|---|---|---|---|
| 4,798,050 | A * | 1/1989 | Nakamura et al. | 60/329 |
| 4,798,177 | A * | 1/1989 | Oomura et al. | 123/41.12 |
| 4,941,437 | A * | 7/1990 | Suzuki et al. | 123/41.12 |
| 6,026,891 | A * | 2/2000 | Fujiyoshi et al. | 165/104.33 |
| 6,195,989 | B1 * | 3/2001 | Hall et al. | 60/329 |
| 6,463,891 | B2 * | 10/2002 | Algrain et al. | 123/41.12 |
| 7,275,368 | B2 * | 10/2007 | Furuta et al. | 60/329 |
| 2001/0029907 | A1 * | 10/2001 | Algrain et al. | 123/41.29 |
| 2005/0254959 | A1 * | 11/2005 | Furuta et al. | 417/46 |
| 2008/0051974 | A1 * | 2/2008 | Hayashi | 701/102 |

FOREIGN PATENT DOCUMENTS

| | | | |
|---|---|---|---|
| JP | 62050219 | A | 3/1987 |
| JP | 5-288053 | A | 11/1993 |
| JP | 6-58127 | U | 8/1994 |
| JP | 2000-110560 | A | 4/2000 |
| JP | 2003-54250 | A | 2/2003 |
| JP | 2006-45808 | A | 2/2006 |

* cited by examiner

*Primary Examiner* — Ramesh B Patel
(74) *Attorney, Agent, or Firm* — Birch, Stewart, Kolasch & Birch, LLP

(57) ABSTRACT

A cooling fan controller is provided for controlling the revolving speed of a cooling fan that introduces outside air as a cooling wind to cool a fluid being cooled; in order to optimally control the revolving speed if the cooling fan in accordance with load, and to suppress noise caused by the cooling fan. The cooling fan controller includes a fluid temperature sensor 40 for sensing a temperature $T_o$ of the fluid, an air temperature sensor 30 for sensing a temperature $T_a$ of the air, and a control 20 for calculating a difference between the fluid temperature $T_o$ sensed by the fluid temperature sensor 40 and the air temperature $T_a$ sensed by the air temperature sensor 30, and setting a target revolving speed $N_f$ of the cooling fan in accordance with a magnitude of the calculated difference.

9 Claims, 6 Drawing Sheets

COOLING FAN CONTROLLER FOR CONTROLLING REVOLVING FAN BASED ON FLUID TEMPERATURE AND AIR TEMPERATURE

BACKGROUND OF THE INVENTION

1. Field of the Invention

The present invention relates to a controller, for controlling the revolving speed (number of revolutions) of a cooling fan, which is suitable for use in a cooling fan mounted in working machinery such as a hydraulic shovel.

2. Description of the Related Art

Working machines, such as a hydraulic shovel, are being used in urban areas and residential areas with ever-increasing frequency, so that machine noise during operation has become an important consideration. The generation of machine noise is greatly affected by the presence of a cooling fan that introduces the air as a cooling wind into cooling equipments such as an oil cooler and radiator.

Cooling fans are normally designed, taking a severe operating environment into account. For example, even when the air temperature is high such as 30° C. and an engine runs continuously in a condition of maximum load such as full throttle, the cooling ability of cooling equipments is raised by increasing the revolving speed of the cooling fan to admit a cooling wind at a higher volume into the cooling equipments so that the engine is not overheated.

However, if the revolving speed of the cooling fan is increased, the rotational resistance due to air will become great, and wind noise by revolution of the cooling fan will be increased. This will have a great influence on the generation of noise.

For noise reduction, it is preferable to make the revolving speed of cooling fans as low as possible except when necessary, such as high-load time, etc.

Because of this, a variety of techniques have been developed for controlling the revolving speed of a cooling fan.

For example, the revolving speed of a cooling fan is being controlled according to the temperature of hydraulic operating oil employed for the operation and travel of working machinery.

Furthermore, for example patent document 1, regarding construction machinery (working machinery), discloses a technique that controls the revolving speed of a cooling fan by a fan controller in accordance with the temperature (water temperature) $T_w$ of engine-cooling water and the temperature (oil temperature) $T_o$ of the hydraulic operating oil circulating through a hydraulic system.

More specifically, in the technique of the above patent document 1, the water temperature $T_w$ is detected by a water-temperature sensor, and the oil temperature $T_o$ is detected by an oil-temperature sensor. When the detected water temperature $T_w$ and oil temperature $T_o$ are lower than predetermined first temperature $Tw_1$ and $To_1$, the cooling fan is not operated.

When the water temperature $T_w$ is between the first temperature $Tw_1$ and a second temperature $Tw_2$ higher than the first temperature $Tw_1$ and the oil temperature To is lower than the first temperature $To_1$, and when the water temperature $T_w$ is lower than the first temperature $Tw_1$ and the oil temperature $T_o$ is between the first temperature $To_1$ and a second temperature $To_2$ higher than the first temperature $To_1$, the cooling fan is operated at low speeds.

When the water temperature $T_w$ and oil temperature $T_o$ are between the first temperatures $Tw_1$ and $To_1$ and the second temperature $Tw_2$ and $To_2$, the cooling fan is operated at intermediate speeds.

When the water temperature $T_w$ is higher than the second temperature $Tw_2$ and the oil temperature $T_o$ is between the first temperature $To_1$ and the second temperature $To_2$, when the water temperature $T_w$ is between the first temperature $Tw_1$ and the second temperature $Tw_2$ and the oil temperature $T_o$ is higher than the second temperature $To_2$, and when the water temperature $T_w$ and oil temperature $T_o$ are higher than the second temperatures $Tw_2$ and $To_2$, the cooling fan is operated at high speeds.

Patent Document 1: Japanese Patent laid-open publication No. HEI 5-288053

SUMMARY OF THE INVENTION

Problems to be Solved by the Invention

However, engine load (i.e., the generation of heat of an engine) is also affected by factors other than oil temperature and water temperature.

It is known that the cooling ability of the cooling equipments for cooling hydraulic operating oil or engine-cooling water is proportional to the temperature and volume of a cooling wind admitted by a cooling fan. That is, the cooler the cooling wind is and higher the wind volume is, the more efficiently the hydraulic operating oil or engine-cooling water is cooled.

However, for instance, in cooling hydraulic operating oil by a cooling wind with a predetermined volume, there are two situations. In one situation, oil temperature continues to hold about 70° C. when the temperature of the cooling wind is as low as 0° C. In another situation, oil temperature continues to hold about 70° C. when the temperature of the cooling wind is as high as 30° C. That is, there is a situation where oil temperature holds the same temperature though the cooling abilities by the cooling wind differ.

More specifically, the former situation means that the heating value of the hydraulic operating oil is large, i.e., it means that great work is performed on the hydraulic operating oil and thus the engine load is high. On the other hand, the latter situation means the heating value of the hydraulic operating oil is small, i.e., it means that little work is performed on the hydraulic operating oil and thus the engine load is low. For that reason, although the former situation is better in cooling ability than the latter situation, the hydraulic operating oil is cooled down to only the same oil temperature as that in the latter situation.

Therefore, if the revolving speed of the cooling fan is merely controlled by only oil temperature, there is a fear that, when the engine load is high, rotation of the cooling fan will be insufficient and therefore the engine will be overheated, or there is another fear that, when the engine load is not high, the cooling fan will be excessively rotated and therefore the machine noise will be increased.

In addition, strictly speaking, the control disclosed in the patent document 1 that is based on oil temperature and water temperature is not performed according to engine load. As a result, as described above, there is a fear that rotation of the cooling fan will be insufficient, or the cooling fan will be excessively rotated.

Thus, it is preferable that the revolving speed of a cooling fan be finely controlled according to engine load.

The present invention has been made in view of the problems described above. Accordingly, it is an object of the present invention to provide a cooling fan controller and a cooling fan controller for working machinery that optimally control the revolving speed of the cooling fan in accordance with load to suppress noise caused by the cooling fan.

Means for Solving the Problems

To achieve this object and in accordance with a first aspect of the present invention, there is provided a cooling fan controller for controlling a revolving speed of a cooling fan that introduces outside air as a cooling wind to cool a fluid being cooled. The cooling fan controller includes a fluid temperature sensor for sensing a temperature of the fluid; an air temperature sensor for sensing a temperature of the air; and control means for calculating a difference between the fluid temperature sensed by the fluid temperature sensor and the air temperature sensed by the air temperature sensor, and setting a target revolving speed of the cooling fan in accordance with a magnitude of the calculated difference.

The cooling fan controller according to the second aspect of the present invention is characterized in that, in the controller as set forth in the first aspect of the present invention, the difference has a first reference difference and a second reference difference greater than the first reference difference as reference values;

the target revolving speed has a first minimum revolving speed as a first lower limit value and has a first maximum revolving speed as a first upper limit value; and the control means if the difference is less than or equal to the first reference difference, sets the target revolving speed at the first minimum revolving speed, if the difference is greater than the second reference difference, sets the target revolving speed at the first maximum revolving speed, and if the difference is greater than the first reference difference and less than or equal to the second reference difference, sets the target revolving speed at a revolving speed linearly interpolated between the first minimum revolving speed and the first maximum revolving speed in accordance with a magnitude of the difference.

The cooling fan controller according to the third of the present invention is characterized in that, in the controller as set forth in the second aspect of the present invention, the fluid temperature has a first reference fluid temperature and a second reference fluid temperature greater than the first reference fluid temperature as reference values;

the target revolving speed further has a second minimum revolving speed as a second lower limit value and further has a second maximum revolving speed as a second upper limit value; and the control means if the fluid temperature is less than or equal to the first reference fluid temperature, sets the target revolving speed at the second minimum revolving speed, if the fluid temperature is greater than the second reference fluid temperature, sets the target revolving speed at the second maximum revolving speed, and if the fluid temperature is greater than the first reference fluid temperature and less than or equal to the second reference fluid temperature, sets the target revolving speed at a revolving speed linearly interpolated between the second minimum revolving speed and the second maximum revolving speed in accordance with the magnitude of the fluid temperature, and sets, as a final target revolving speed, the greater one of the target revolving speed based on the difference and the target revolving speed based on the fluid temperature.

The cooling fan controller for working machinery according to the fourth aspect of the present invention is characterized in that the cooling fan controller as set forth in any of first through third aspect of the present invention is applicable to working machinery.

The cooling fan controller for working machinery according to the fifth aspect of the present invention is characterized in that, in the cooling fan controller for working machinery as set forth in the fourth aspect of the present invention, the fluid is hydraulic operating oil employed for operation and travel of the working machinery.

Effects of the Invention

According to the cooling fan controller of the first aspect of the present invention, in controlling the revolving speed of the cooling fan, the difference between the temperature of the fluid and the temperature of the air is employed, so a load on a driving source (e.g., a driving source for the cooling fan) that performs work on the fluid can be properly determined.

Since the target revolving speed of the cooling fan is set according to the determined load, the revolving speed of the cooling fan can be finely and optimally controlled. Accordingly, because the cooling fan is not rotated to more than necessity, machine noise that is generated by the cooling fan can be suppressed.

According to the cooling fan controller of the second aspect of the present invention, a target revolving speed is set at a revolving speed linearly interpolated according to the magnitude of the difference between the fluid temperature and the air temperature, so the revolving speed of the cooling fan can be more finely controlled.

In addition, the target revolving speed has an upper limit value and a lower limit value, and if the difference is less than or equal to the first reference difference, the target revolving speed is set at the first minimum revolving speed. Further, if the difference is greater than the second reference difference, the target revolving speed is set at the first maximum revolving speed. Therefore, with the cooling ability being sufficiently ensured, noise can be suppressed, and fuel consumption can be improved.

According to the cooling fan controller of the third aspect of the present invention, the greater one of the target revolving speed based on the difference between the fluid temperature and the air temperature and the target revolving speed based on the fluid temperature is determined as a final target revolving speed, so the revolving speed of the cooling fan can be more finely controlled. Therefore, with the cooling ability being sufficiently ensured, noise can be suppressed, and fuel consumption can be improved.

According to the cooling fan controller for working machinery of the fourth aspect of the present invention, the revolving speed of the cooling fan mounted in working machinery can be optimally controlled. In the case where the cooling fan is driven by an engine that is a power source for working machinery, it is possible to reduce extra engine output that is consumed for driving the cooling fan.

According to the cooling fan controller for working machinery of the fifth aspect of the present invention, the temperature of hydraulic operating oil on which a load on a machine body is easily reflected is employed, so a load on the engine can be determined with a high degree of accuracy.

BRIEF DESCRIPTION OF THE DRAWINGS

FIG. 3(*c*) is a graph showing the revolving speed of the cooling fan that is set by a conventional cooling fan controller;

DESCRIPTION OF REFERENCE NUMERALS

Figure 1:
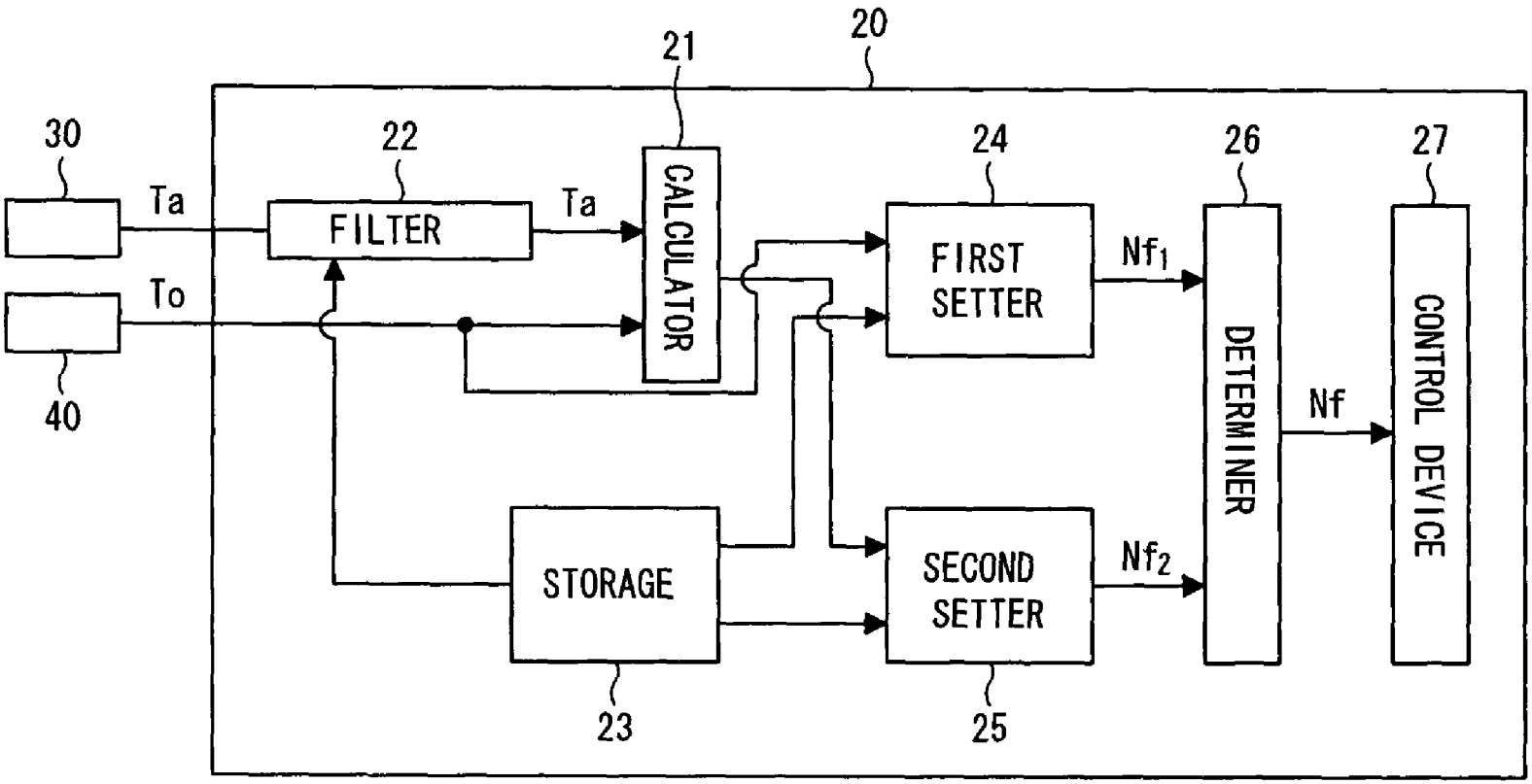
FIG. 1 is a block diagram showing a cooling fan controller in accordance with an embodiment of the present invention.

1 Hydraulic shovel
2 Under carriage
3 Upper structure
3*a* Revolving frame
4 Working attachment
5 Counterweight
10 Engine
11 Hydraulic pump
12 Cooling equipment
13 Cooling fan
14 Fan-driving shaft
15 Viscous clutch (fluid coupling)
20 Controller (control means)
21 Calculator
22 Filter
23 Storage
24 First setter
25 Second setter
26 Determiner
27 Control device
30 Air temperature sensor
40 Oil temperature sensor (fluid temperature sensor)
$N_f$ Revolving speed of a cooling fan (target revolving speed)
$N_{fmin}$ Minimum revolving speed (first minimum revolving speed, second minimum revolving speed)
$N_{fmax1}$ First maximum revolving speed
$N_{fmax2}$ Second maximum revolving speed
$\Delta T$ Air-oil difference (difference)
$\Delta T_1$ First reference air-oil difference (first reference difference)
$\Delta T_2$ Second reference air-oil difference (second reference difference)
$T_o$ Oil temperature
$T_{o1}$ First reference oil temperature (first reference fluid temperature)
$T_{o2}$ Second reference oil temperature (second reference fluid temperature)
$T_{o3}$ Third reference oil temperature (third reference fluid temperature)
$T_a$ Air temperature
$T_{amin}$ Minimum air temperature
$T_{o1}'$ Oil temperature at which a conventional target revolving speed rises

DETAILED DESCRIPTION OF THE INVENTION

An embodiment of the present invention will hereinafter be described with reference to the accompanying drawings.

Embodiment

Figure 2:
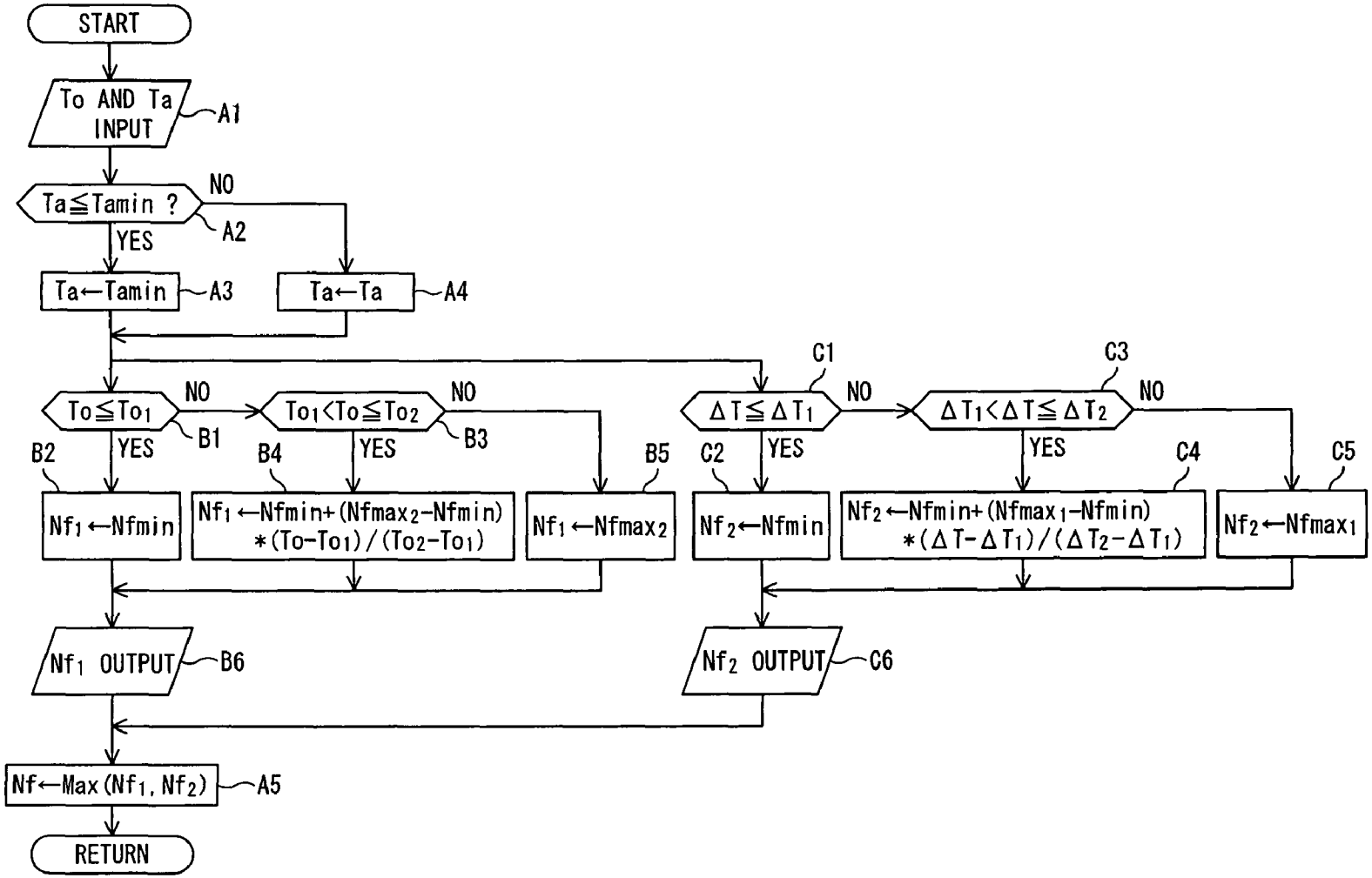
FIG. 2 is a flowchart showing the contents of control that is performed by the cooling fan controller of the embodiment of the present invention.
Figure 3A:
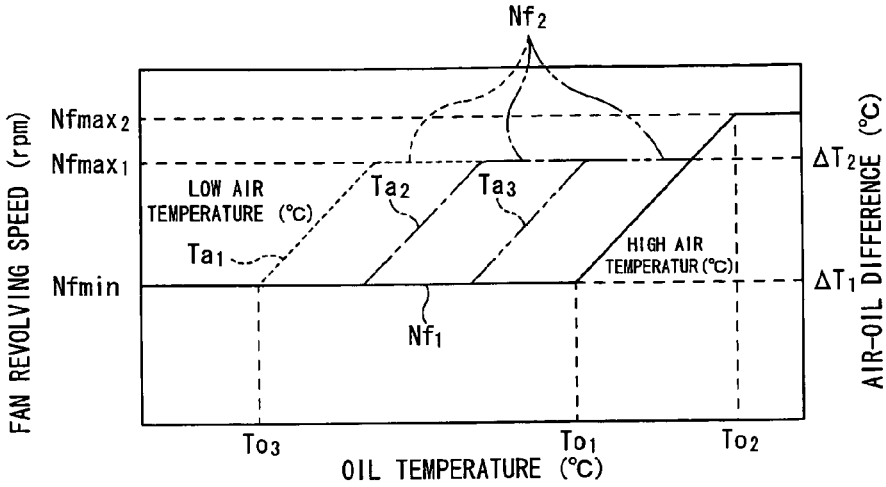
FIGS. 3(*a*) and 3(*b*) are graphs showing the revolving speed of a cooling fan that is set by the cooling fan controller of the embodiment of the present invention.
Figure 3B:
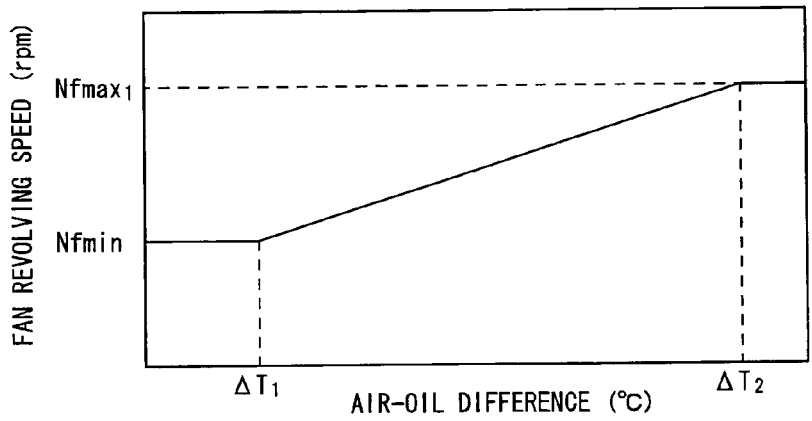
Figure 3C:
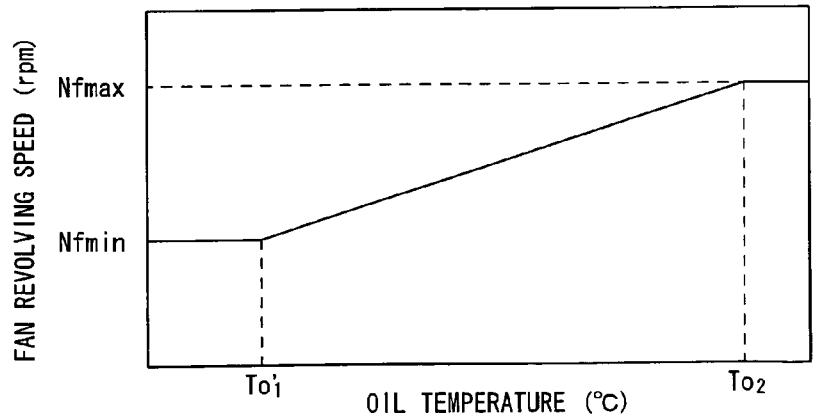
Figure 4A:
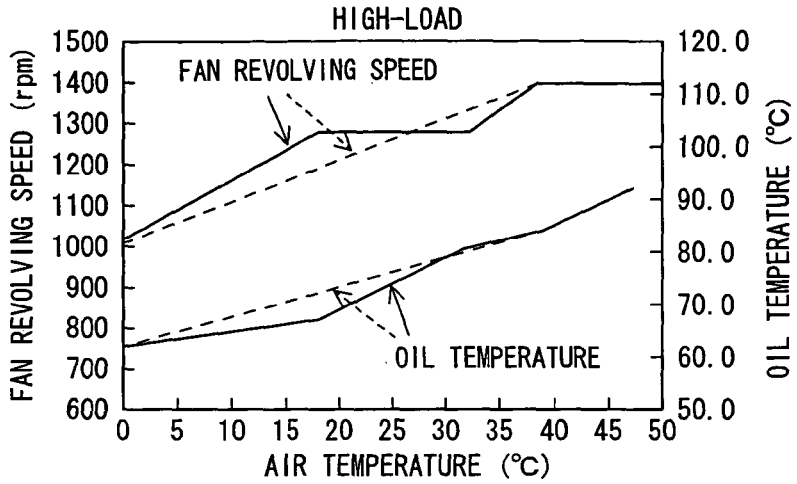
FIGS. 4(*a*) to 4(*c*) are graphs showing the experimental results controlled by the cooling fan controller of the embodiment of the present invention and the experimental results controlled by the conventional controller at the same time, FIG. 4(*a*) showing at high-load, FIG. 4(*b*) showing at intermediate-load, and FIG. 4(*c*) showing at low-load.
Figure 4B:
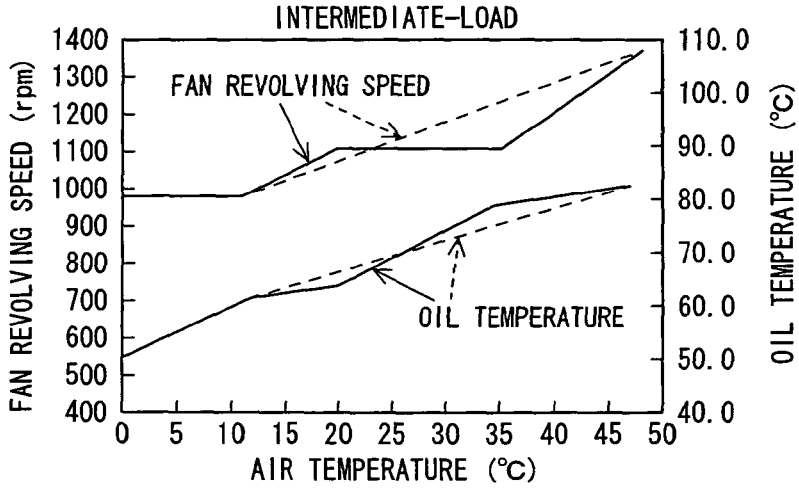
Figure 4C:
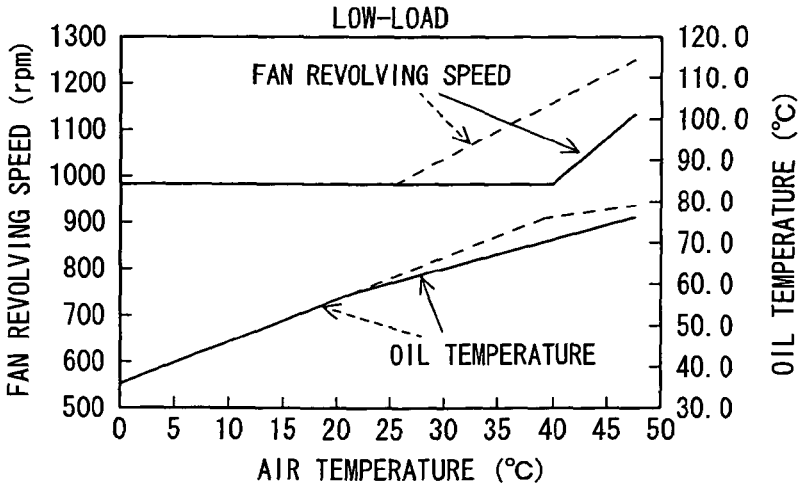
Figure 5:
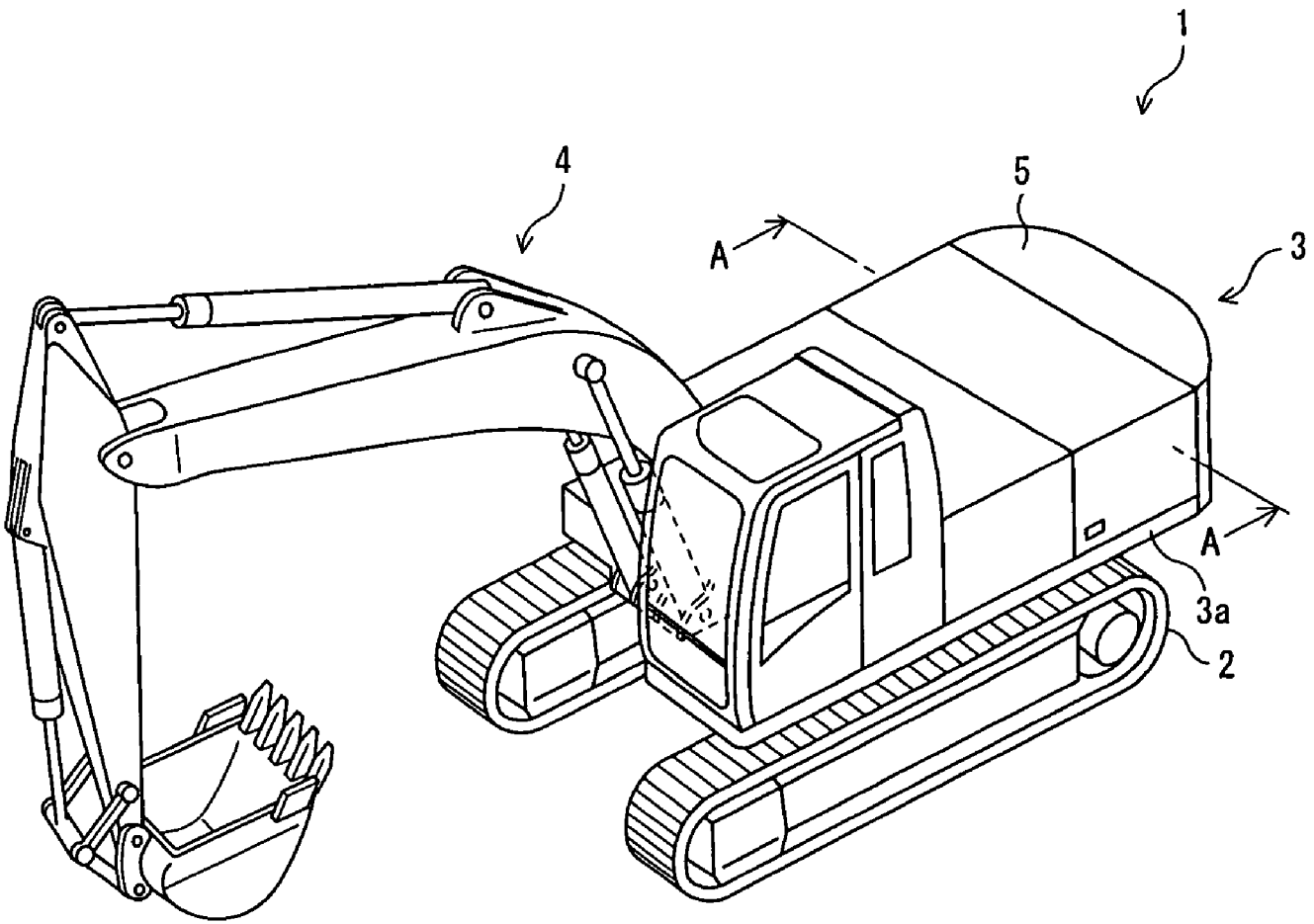
FIG. 5 is a perspective view showing a hydraulic shovel equipped with the cooling fan controller of the embodiment of the present invention.
Figure 6:
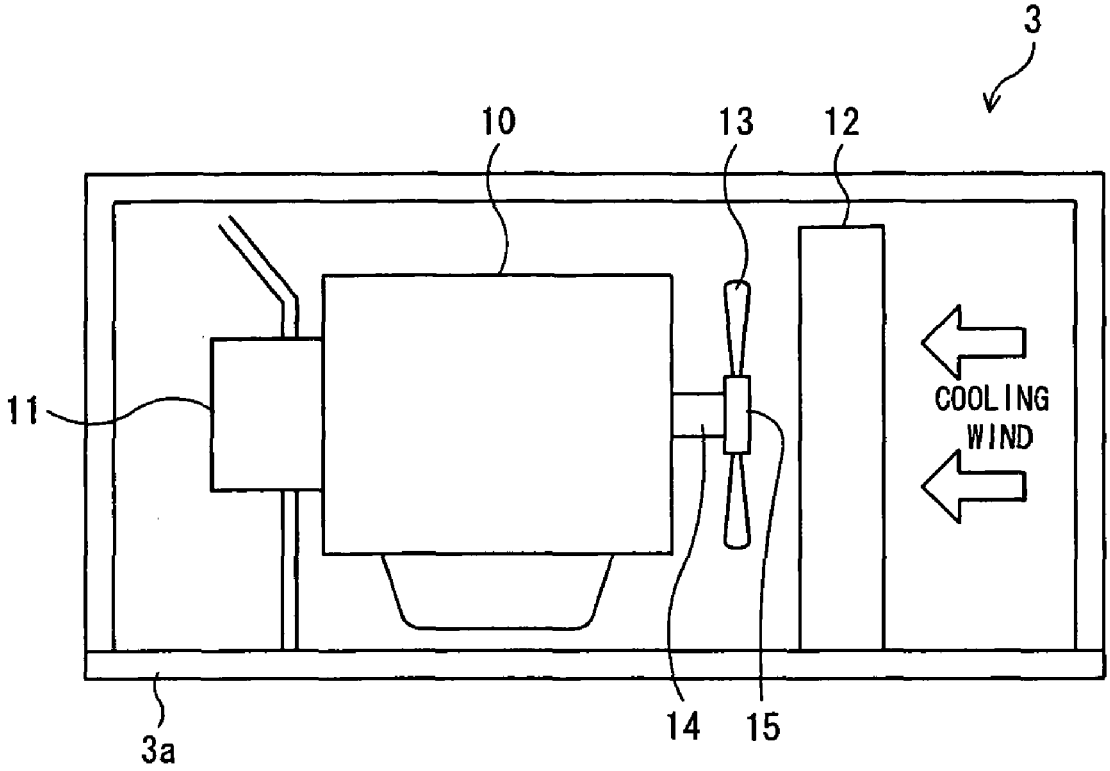
FIG. 6 is a sectional view of the hydraulic shovel equipped with the cooling fan controller of the embodiment of the present invention, taken along line A-A of FIG. 5.

FIGS. 1 to 6 show a cooling fan controller in accordance with an embodiment of the present invention. FIG. 1 is a block diagram showing the controller, FIG. 2 is a flowchart showing the contents of control which is performed by the controller, and FIGS. 3(*a*) and 3(*b*) are graphs showing the revolving speed (target revolving speed) of the cooling fan that is set by the controller, and FIG. 3(*c*) is a graph showing the revolving speed of the cooling fan that is set by a conventional cooling fan controller that employs only oil temperature information. FIGS. 4(*a*) to 4(*c*) are graphs showing the revolving speed of the cooling fan versus oil temperature, obtained by the experimental results controlled by the cooling fan controller and conventional controller, FIG. 4(*a*) showing at high-load, FIG. 4(*b*) showing at intermediate-load, and FIG. 4(*c*) showing at low-load. Also, FIG. 5 is a perspective view showing a hydraulic shovel equipped with the cooling fan controller; and FIG. 6 is a sectional view taken along line A-A of FIG. 5. Note in FIG. 6 that the sectional areas are shown without hatching.

<Structure>

In the embodiment, a description is given of a controller for a cooling fan mounted in a hydraulic shovel 1 that is a typical example of working machinery.

As illustrated in FIG. 5, the hydraulic shovel 1 is constituted by an under carriage 2, an upper structure (machine body) 3 rotatably connected to the under carriage 2, and a working attachment 4, which extends forward from the upper structure 3.

The upper structure 3 has a revolving frame 3*a* as a mount, and a counterweight 5 placed on the rear end portion of the revolving frame 3*a* for balancing with the working attachment 4. In front of the counterweight 5, the upper structure 3, as shown in FIG. 6, contains an engine 10, which is a power source for the hydraulic shovel 1, a hydraulic pump 11, which is driven by the engine 10, a cooling equipment 12, such as a radiator in which engine-cooling water is cooled or an oil cooler used to cool hydraulic operating oil (fluid being cooled), a cooling fan 13 by which a cooling wind is introduced to a cooling equipment 12, a hydraulic operating oil tank (not shown), in which hydraulic operating oil is stored, and a controller (control means) 20 (see FIG. 1), which sets a target revolving speed (also called a fan revolving speed) $N_f$ of the cooling fan 13.

The cooling fan 13, in order to be driven by the engine 10, is mounted on the driving shaft 14 (which is the same shaft as the driving shaft of the engine 10) through a viscous clutch (fluid coupling) 15 which is rotation-transmitting means.

The viscous clutch 15 is a device that exploits the shear of silicon oil whose viscosity is high, for generating torque in accordance with a differential revolving speed. That is, power of the rotation of the fan-driving shaft 14 creates the flow of silicon oil, which transmits power of the rotation to the cooling fan 13, but since slip occurs in the viscous clutch 15 because of the viscosity of silicon oil, all of the rotation power of the fan-driving shaft 14 is not transmitted and thus the cooling fan 13 is controlled to a revolving speed differing from that of the engine 10. The controller 20 is adapted to adjust the slip ratio of the silicon oil to control the revolving speed $N_f$ of the cooling fan 13.

At an appropriate position on the machine body 3, an air temperature sensor 30 (see FIG. 1) is installed for sensing the surrounding temperature (outside air temperature) $T_a$ during operation. To the hydraulic operating oil tank, an oil-temperature sensor 40 (see FIG. 1) is attached for sensing the temperature of the hydraulic operating oil (fluid temperature or oil temperature) $T_o$.

The air temperature $T_a$ sensed by the air temperature sensor 30, and the oil temperature $T_o$ sensed by the oil temperature sensor 40, are input to the controller 20.

The controller 20, as shown in FIG. 1, has a calculator 21 for calculating a difference ΔT between the input air temperature $T_a$ and oil temperature $T_o$ (hereinafter referred to as an air-oil difference ΔT), a filter 22 for filtering the air temperature $T_a$ which is input to the calculator 21, a storage 23 for respectively storing the predetermined reference values (predetermined values) of the air temperature $T_a$, oil temperature $T_o$, and target revolving speed $N_f$ of the cooling fan 13, a first setter 24 that uses only the oil temperature $T_o$ to set a first target revolving speed $N_{f1}$ of the cooling fan 13, a second setter 25 that uses the air-oil difference ΔT to set a second target revolving speed $N_{f2}$ of the cooling fan 13, a determiner 26 for determining the greater of the two target revolving speeds $N_{f1}$ and $N_{f2}$ set by the first setter 24 or the second setter 25 as a final target revolving speed $N_f$, and a control device 27 for controlling the revolving speed of the cooling fan 13 so that it reaches the final target revolving speed $N_f$ determined by the determiner 26.

To the calculator 21, the air temperature $T_a$ filtered by the filter 22, and the oil temperature $T_o$ sensed by the oil temperature sensor 40, are input. Then, the calculator 21 is adapted to output the air-oil difference ΔT calculated using the air temperature $T_a$ and oil temperature $T_o$ to the second setter 25. The air-oil difference ΔT correlates with the machine load (the load of engine 10) during operation. It has been found that the greater the air-oil difference ΔT, the higher the load.

The filter 22 is adapted to output the filtered air temperature $T_a$ to the calculator 21. To the filter 22, the air temperature $T_a$ sensed by the air temperature sensor 30, and hereinafter-mentioned the minimum air temperature $T_{amin}$ stored in the storage 23, are input. The filter 22 first compares the sensed air temperature $T_a$ with the minimum air temperature $T_{amin}$ stored in the storage 23. If the sensed air temperature $T_a$ is lower than or equal to the minimum air temperature $T_{amin}$, ($T_a \leqq T_{amin}$), the filter 22 outputs the minimum air temperature $T_{amin}$ to the calculator 21 as the air temperature $T_a$. On the other hand, if the sensed air temperature $T_a$ is higher than the minimum air temperature $T_{amin}$ ($T_a > T_{amin}$), the filter 22 outputs the sensed air temperature $T_a$ to the calculator 21 as the air temperature $T_a$. That is, the filter 22 is adapted to prescribe the lower limit value $T_{amin}$ of the air temperature $T_a$ that is input to the calculator 21.

The storage 23 stores a minimum revolving speed $N_{fmin}$, preset as the lower limit value of the target revolving speed $N_f$ of the cooling fan 13, and a first maximum revolving speed $N_{fmax1}$ and a second maximum revolving speed $N_{fmax2}$, preset as the upper limit values of the target revolving speed $N_f$ of the cooling fan 13. The second maximum revolving speed $N_{fmax2}$ is set at a higher value than the first maximum revolving speed $N_{fmax1}$. That is, the target revolving speed $N_f$ has two-staged upper limit values $N_{fmax}$.

The storage 23 also stores a first reference air-oil difference (first reference difference) $\Delta T_1$, and a second reference air-oil difference (second reference difference) $\Delta T_2$ greater than the first reference difference $\Delta T_1$, which are preset as a reference value of the air-oil difference ΔT. At the same time, the storage 23 stores a first reference oil temperature (first reference fluid temperature) $T_{o1}$ and a second reference oil temperature (second reference fluid temperature) $T_{o2}$ higher than the first reference oil temperature $T_{o1}$, which are preset as a reference value of an oil temperature $T_o$.

The storage 23 further stores a minimum air temperature $T_{amin}$, preset as a reference value of an air temperature $T_a$.

The minimum air temperature $T_{amin}$ is used for setting a minimum oil temperature $T_{o3}$ at which control based on an air-oil difference ΔT is started by the second setter 25. It has been found that when the temperature of the hydraulic operating oil is lower than or equal to a certain oil temperature (third reference oil temperature) $T_{o3}$, the hydraulic operating oil does not need to be cooled by raising the fan revolving speed $N_f$, from the viewpoint of hydraulic equipment performance, and that it is desirable from the viewpoint of noise and fuel consumption to fix the fan revolving speed at a minimum revolving speed $N_{fmin}$ such that heat fatigue does not occur in hydraulic equipment. To meet such a demand, by setting a minimum air temperature $T_{amin}$, the cooling fan 13 is set to the second target revolving speed $N_{f2}$ at the minimum air temperature $T_{amin}$ until the oil temperature $T_o$ rises to the predetermined temperature $T_{o3}$ by the second setter 25.

The first setter 24 receives the first reference oil temperature $T_{o1}$, the second reference oil temperature $T_{o2}$, the minimum revolving speed $N_{fmin}$ and the second maximum revolving speed $N_{fmax2}$ from the storage 23, and also is input the oil temperature $T_o$ sensed by the oil temperature sensor 40.

Then, the first setter 24, as shown by solid lines in FIG. 3(*a*), when the oil temperature $T_o$ is lower than or equal to the first reference oil temperature $T_{o1}$ ($T_o \leqq T_{o1}$), is adapted to set the first target revolving speed $N_{f1}$ at the minimum revolving speed $N_{fmin}$. Also, when the oil temperature $T_o$ is higher than the second reference oil temperature $T_{o2}$ ($T_o > T_{o2}$), the first setter 24 is adapted to set the first target revolving speed $N_{f1}$ at the second maximum revolving speed $N_{fmax2}$.

Furthermore, when the oil temperature $T_o$ is higher than the first reference oil temperature $T_{o1}$ and lower than or equal to the second reference oil temperature $T_{o2}$ ($T_{o1} < T_0 \leqq T_{o2}$), as indicated by the following Eq. 1, the first setter 24 is adapted to set the first target revolving speed $N_{f1}$ at a value linearly interpolated between the minimum revolving speed $N_{fmin}$ and the second maximum revolving speed $N_{fmax2}$ in accordance with the magnitude of the oil temperature $T_o$.

[Eq. 1]

$$N_{f1} = N_{fmin} + (N_{fmax2} - N_{fmin}) \times (T_o - T_{o1}) / (T_{o2} - T_{o1}) \quad (1)$$

That is, until the oil temperature $T_o$ rises from the first reference oil temperature $T_{o1}$ to the second reference oil temperature $T_{o2}$, the first target revolving speed $N_{f1}$ is caused to rise linearly from the minimum revolving speed $N_{fmin}$ to the second maximum revolving speed $N_{fmax2}$. Note that the first reference oil temperature $T_{o1}$ is set at a temperature higher than the oil temperature $T_{o1}'$ at which the target revolving speed starts to rise in the conventional controller, shown in FIG. 3(*c*). The conventional controller is adapted to set the target revolving speed $N_f$ by only the oil temperature $T_o$. As shown in FIG. 3(*c*), if the oil temperature $T_o$ exceeds the predetermined oil temperature $T_{o1}'$, the target revolving speed $N_{f1}$ is caused to rise linearly at a predetermined gradient until it reaches the upper limit value $N_{fmax}$.

The second setter 25 receives the air-oil difference ΔT calculated in the calculator 21, and also receives the first reference air-oil difference $\Delta T_1$, the second reference air-oil difference $\Delta T_2$, the minimum revolving speed $N_{fmin}$, the first maximum revolving speed $N_{fmax1}$, and the minimum air temperature $T_{amin}$ from the storage 23.

Then, the second setter 25, as shown in FIG. 3(*b*), when the air-oil difference $\Delta T$ is less than or equal to the first reference air-oil difference $\Delta T_1$ ($\Delta T \leqq \Delta T_1$), is adapted to set the second target revolving speed $N_{f2}$ at the minimum revolving speed $N_{fmin}$. Also, when the air-oil difference $\Delta T$ is greater than the second reference air-oil difference $\Delta T_2$ ($\Delta T > \Delta T_2$), the second setter 25 is adapted to set the second target revolving speed $N_{f2}$ at the first maximum revolving speed $N_{fmax1}$.

Furthermore, when the air-oil difference $\Delta T$ is greater than the first reference air-oil difference $\Delta T_1$ and less than or equal to the second reference air-oil difference $\Delta T_2$ ($\Delta T_1 < \Delta T \leqq \Delta T_2$), as shown by a dashed line, one-dot chain line, and two-dot chain line in FIG. 3(*a*) and as shown in FIG. 3(*b*), the second setter 25 is adapted to set the second target revolving speed $N_{f2}$ at a value linearly interpolated between the minimum revolving speed $N_{fmin}$ and the first maximum revolving speed $N_{fmax1}$ in accordance with the air-oil difference $\Delta T$.

[Eq. 2]

$$N_{f2} = N_{fmin} + (N_{fmax1} - N_{fmin}) \times (\Delta T - \Delta T_1)/(\Delta T_2 - \Delta T_1) \quad (2)$$

That is, as indicated by the above Eq. 2, the second target revolving speed $N_{f2}$ is caused to rise linearly at a predetermined gradient until it reaches the first maximum revolving speed $N_{fmax1}$. In other words, the oil temperature $T_o$ at which the second target revolving speed $N_{f2}$ rises is shifted to a lower temperature side as the air temperature $T_a$ becomes lower.

In FIG. 3(*a*), the air temperature $T_a$ becomes lower as it goes toward the left side ($T_{a1} < T_{a2} < T_{a3}$). The oil temperature $T_{o3}$ at which the target revolving speed $N_{f2}$ starts to rise is the addition of the first reference air-oil difference $\Delta T_1$ to the minimum air temperature $T_{amin}$ ($T_{o3} = T_{amin} + \Delta T_1$).

The determiner 26 is adapted to determine the greater one of the first and second target revolving speeds $N_{f1}$ and $N_{f2}$ input from the first and second setters 24 and 25 as the final target revolving speed $N_f$, and output the final target revolving speed $N_f$ to the control device 27.

The control device 27 is adapted to set the slip ratio of the viscous clutch 15 in accordance with the final target revolving speed $N_f$ input from the determiner 26, send the set signal to the viscous clutch 15, and control the cooling fan 13 so that the revolving speed reaches the final target revolving speed $N_f$.

<Action>

The cooling fan controller of the embodiment of the present invention, as shown in FIG. 1, is constituted by the air temperature sensor 30, oil temperature sensor 40, and controller 20, and is controlled according to a processing procedure such as the one shown in FIG. 2.

As shown in FIG. 2, in step A1, the air temperature $T_a$ sensed by the air temperature sensor 30 is input to the filter 22 of the controller 20, and the oil temperature $T_o$ sensed by the oil temperature sensor 40 is input to the calculator 21 and first setter 24 of the controller 20. The processing procedure then advances to step A2.

In step A2, the filter 22 compares the input air temperature $T_a$ with the minimum air temperature $T_{amin}$ stored in the storage 23. If the input air temperature $T_a$ is lower than or equal to the minimum air temperature $T_{amin}$ ($T_a \leqq T_{amin}$), the processing procedure advances to step A3. On the other hand, if the air temperature $T_a$ is higher than the minimum air temperature $T_{amin}$ ($T_a > T_{amin}$), the processing procedure advances to step A4.

In step A3, the filter 22 outputs the minimum air temperature $T_{amin}$ as the air temperature $T_a$ to the calculator 21. The processing procedure then advances to step B1 and step C1.

In step A4, the filter 22 outputs the air temperature $T_a$ sensed by the air temperature sensor 30 as the air temperature $T_a$ to the calculator 21. The processing procedure then advances to step B1 and step C1.

In step B1, the first setter 24 determines whether the oil temperature $T_o$ is lower than or equal to the first reference oil temperature $T_{o1}$ stored in the storage 23 ($T_o \leqq T_{o1}$). If the answer is Yes ($T_o \leqq T_{o1}$), the processing procedure advances to step B2. On the other hand, if the answer is No ($T_o > T_{o1}$), the procedure advances to step B3.

In step B2, the first target revolving speed $N_{f1}$ by oil-temperature control is set at the minimum revolving speed $N_{fmin}$.

In step B3, the first setter 24 determines whether the oil temperature $T_o$ is less than or equal to the second reference oil temperature $T_{o2}$ stored in the storage 23 ($T_o \leqq T_{o2}$). If the answer is Yes ($T_{o1} < T_o \leqq T_{o2}$), the processing procedure advances to step B4. On the other hand, if the answer is No ($T_o > T_{o2}$), the procedure advances to step B5.

In step B4, the first target revolving speed $N_{f1}$ by oil-temperature control, as indicated by Eq. (1), is set by being interpolated linearly between the minimum revolving speed $N_{fmin}$ and the second maximum revolving speed $N_{fmax2}$ in accordance with the oil temperature $T_o$.

In step B5, the first target revolving speed $N_{f1}$ by oil-temperature control is set at the second maximum revolving speed $N_{fmax2}$.

In step B6, the first setter 24 outputs the first target revolving speed $N_{f1}$ by oil-temperature control to the determiner 26. Then, the procedure advances to step A5.

In step C1, the calculator 21 calculates a difference (air-oil difference) $\Delta T$ between the oil temperature $T_o$ and the air temperature $T_a$, and inputs the difference $\Delta T$ to the second setter 25. Then, the second setter 25 determines whether the air-oil difference $\Delta T$ is less than or equal to the first reference air-oil difference $\Delta T_1$ stored in the storage 23 ($\Delta T \leqq \Delta T_1$). If the answer is Yes ($\Delta T \leqq \Delta T_1$), the processing procedure advances to step C2. On the other hand, if the answer is No ($\Delta T > \Delta T_1$), the procedure advances to step C3.

In step C2, the second target revolving speed $N_{f2}$ by air-oil difference control is set at the minimum revolving speed $N_{fmin}$.

In step C3, the second setter 25 determines whether the oil temperature $T_o$ is less than or equal to the second reference air-oil difference $\Delta T_2$ stored in the storage 23 ($\Delta T_1 < \Delta T \leqq \Delta T_2$). If the answer is Yes ($\Delta T_1 < \Delta T \leqq \Delta T_2$), the processing procedure advances to step C4. On the other hand, if the answer is No ($\Delta T > \Delta T_2$), the procedure advances to step C5.

In step C4, the second target revolving speed $N_{f2}$ by air-oil difference control, as indicated by Eq. (2), is set by being interpolated linearly between the minimum revolving speed $N_{fmin}$ and the first maximum revolving speed $N_{fmax1}$ in accordance with the air-oil difference $\Delta T$.

In step C5, the second target revolving speed $N_{f2}$ by air-oil difference control is set at the first maximum revolving speed $N_{fmax1}$.

In step C6, the second setter 25 outputs the second target revolving speed $N_{f2}$ by air-oil difference control to the determiner 26. Then, the procedure advances to step A5.

In step A5, the determiner 26 compares the first target revolving speed $N_{f1}$ that was set according to the oil temperature $T_o$ in step B6, with the second target revolving speed $N_{f2}$ that was set according to the air-oil difference $\Delta T$ in step C6, and determines the greater one of the first target revolving speeds $N_{f1}$ and the second target revolving speed $N_{f2}$ as the final target revolving speed $N_f$.

The control device 27 performs control so that the revolving speed of the cooling fan 13 reaches the final target revolving speed $N_f$ determined by the determiner 26.

This processing procedure is repeatedly executed at predetermined periods.

<Effects>

Thus, according to the cooling fan controller of the embodiment, the greater one of the first target revolving speeds $N_{f1}$ that is based on the oil temperature $T_o$ and the second revolving speeds $N_{f2}$ that is based on the air-oil difference $\Delta T$ is determined as the final target revolving speed $N_f$, so the cooling fan 13 can be controlled at the target revolving speed $N_f$ shown in FIGS. 4(*a*) to 4(*c*). In these FIGS. 4(*a*) to 4(*c*), for comparison, the fan revolving speeds that are controlled based on only the oil temperature $T_o$ by the conventional controller are indicated by dashed lines. Also, FIGS. 4(*a*) to 4(*c*), are graphs in case that the above mentioned parameters are set at $N_{fmin}$=980 rpm, $N_{fmax1}$=1400 rpm, $N_{fmax}$=1280 rpm, $T_{o1}$=76° C., $T_{o2}$=84° C., $T_{o1}'$=50° C., $T_{amin}$=20° C., $\Delta T_1$=41° C., $\Delta T_2$=47° C.

More specifically, as shown in FIG. 4(*a*), at high load (i.e., when the air-oil difference $\Delta T$ is comparatively great), the fan revolving speed $N_f$ rises over approximately the entire range, compared with the conventional controller that is based on only the oil temperature $T_o$. Thus, cooling ability can be ensured.

In addition, as shown in FIG. 4(*b*), at intermediate load, the fan revolving speed $N_f$ is suppressed over approximately the entire range, compared with conventional. Thus, revolution of the cooling fan 13 can be avoided with sufficient cooling ability being ensured.

As shown in FIG. 4(*c*), even at low load (i.e., even when the air-oil difference $\Delta T$ is comparatively small), the fan revolving speed $N_f$ is suppressed over the entire range, compared with conventional. Thus, excessive revolution of the cooling fan 13 can be avoided with sufficient cooling ability being ensured.

Therefore, the revolving speed $N_f$ of the cooling fan 13 is optimally controlled according to load, whereby noise and fuel consumption in operations at the time of low load and intermediate load can be improved with the cooling ability at the time of high load being ensured.

In addition, two maximum revolving speeds $N_{fmax}$ are set so that when the air temperature $T_a$ is high, the maximum revolving speed $N_{f2}$ becomes higher than the maximum revolving speeds $N_{f1}$ that is used during normal temperature. As a result, the engine 10 can be reliably prevented from being overheated.

Moreover, since the oil temperature $T_o$ in hydraulic machinery is employed to calculate an air-oil difference $\Delta T$ between the air temperature $T_a$ and the oil temperature $T_o$, information relating to machine load during operation can be properly exploited.

[Other]

While the present invention has been described with reference to the embodiment thereof, the present invention is not to be limited to the details given herein, but may be modified within the scope of the present invention hereinafter claimed.

For example, in the above mentioned embodiment, while the minimum revolving speed $N_{fmin}$ in the first setter 24 and minimum revolving speed $N_{fmin}$ in the second setter 25 are set at the same value, they may be set at different values.

In the above mentioned embodiment, while the oil temperature sensor 40 is attached to the hydraulic operating oil tank, it may be installed at an appropriate position on the hydraulic circuit through which the hydraulic operating oil circulates.

In the above mentioned embodiment, while control is based on oil temperature, it may be replaced with the temperature of a fluid being cooled, such as engine-cooling water.

In the above mentioned embodiment, although the viscous clutch 15 is interposed between the fan-driving shaft 14 (which is the same shaft as the engine-driving shaft) and the cooling fan 13 so that the fan revolving speed is controlled to an arbitrary value, any type of clutch may be interposed so long as it is a clutch (fluid coupling) that can vary engine revolving speed and fan revolving speed.

The fan-driving shaft 14 may be formed separately from the engine-driving shaft. That is, in the above mentioned embodiment, cooling fan 13 revolves, using part of the driving force of the engine 10, but it may be driven by a dedicated electric motor. In this case, no clutch is required between the cooling fan 13 and the fan-driving shaft 14, and the controller 20 is able to control the fan revolving speed by controlling the revolving speed of the electric motor.

In the above mentioned embodiment, the cooling fan controller of the present invention is applied to the hydraulic shovel 1, but it may be varied in many ways so it can be applied to other working machines such as a bulldozer and a crane, and to various industrial products equipped with a cooling fan.

The invention claimed is:

1. A cooling fan controller for controlling a revolving speed of a cooling fan that introduces outside air as a cooling wind to cool a fluid being cooled, comprising:

a fluid temperature sensor for sensing a temperature of said fluid;

an air temperature sensor for sensing a temperature of said air; and a control unit having, a calculating unit that calculates a difference between said fluid temperature sensed by said fluid temperature sensor and said air temperature sensed by said air temperature sensor, a first setting unit that sets a first target revolving speed of said cooling fan in accordance with said fluid temperature sensed by said fluid temperature sensor, and a second setting unit that sets a second target revolving speed of said cooling fan in accordance with a magnitude of said calculated difference, wherein said control unit controls the revolving speed of said cooling fan on the basis of said first target revolving speed and said second target revolving speed.

2. The cooling fan controller as set forth in claim 1, wherein said second setting unit compares said calculated difference with a first reference difference and a second reference difference greater than said first reference difference as reference values;

said second target revolving speed has a first minimum revolving speed as a first lower limit value and has a first maximum revolving speed as a first upper limit value; and said control unit if said difference is less than or equal to said first reference difference, sets said second target revolving speed at said first minimum revolving speed, if said difference is greater than said second reference difference, sets said second target revolving speed at said first maximum revolving speed, and if said difference is greater than said first reference difference and less than or equal to said second reference difference, sets said second target revolving speed at a revolving speed linearly interpolated between said first minimum revolving speed and said first maximum revolving speed in accordance with a magnitude of said difference.

3. The cooling fan controller as set forth in claim 2, wherein said first setting unit compares said fluid temperature sensed by said fluid temperature sensor with at least one reference fluid temperature;

said at least one reference fluid temperature includes a first reference fluid temperature and a second reference fluid temperature higher than said first reference fluid temperature as reference values;

said first target revolving speed further has a second minimum revolving speed as a second lower limit value and further has a second maximum revolving speed as a second upper limit value; and said control unit if said fluid temperature is lower than or equal to said first reference fluid temperature, sets said first target revolving speed at said second minimum revolving speed, if said fluid temperature is higher than said second reference fluid temperature, sets said first target revolving speed at said second maximum revolving speed, and if said fluid temperature is higher than said first reference fluid temperature and lower than or equal to said second reference fluid temperature, sets said first target revolving speed at a revolving speed linearly interpolated between said second minimum revolving speed and said second maximum revolving speed in accordance with the magnitude of said fluid temperature, and sets the greater one of the first target revolving speed and the second target revolving speed as a final target revolving speed.

4. A working machinery, comprising:

the cooling fan controller as set forth in claim 1.

5. The working machinery as set forth in claim 4, wherein said fluid is hydraulic operating oil employed for operation and travel of said working machinery.

6. A working machinery, comprising:

the cooling fan controller as set forth in claim 2.

7. The working machinery as set forth in claim 6, wherein said fluid is hydraulic operating oil employed for operation and travel of said working machinery.

8. A working machinery, comprising:

the cooling fan controller as set forth in claim 3.

9. The cooling fan controller for working machinery as set forth in claim 8, wherein said fluid is hydraulic operating oil employed for operation and travel of said working machinery.

* * * * *